US005996287A

United States Patent [19]

Sullivan

[11] Patent Number: 5,996,287

[45] **Date of Patent: *Dec. 7, 1999**

[54] APPARATUS FOR SECURELY AND SAFELY PARTITIONING AN AREA

[76] Inventor: Donald H. Sullivan, 956 Troon Trail, Frankfort, Ill. 60423

[ * ] Notice: This patent issued on a continued prosecution application filed under 37 CFR 1.53(d), and is subject to the twenty year patent term provisions of 35 U.S.C. 154(a)(2).

[21] Appl. No.: 08/825,650

[22] Filed: Apr. 3, 1997

[51] Int. Cl.[6] ..... E04B 1/343; E04B 2/82

[52] U.S. Cl. ..... 52/71; 52/239; 160/135; 160/199; 160/206; 160/352

[58] Field of Search ..... 52/71, 239, 241; 160/114, 135, 199, 206, 352

[56] References Cited

U.S. PATENT DOCUMENTS

| | | | |
|---|---|---|---|
| 2,187,408 | 1/1940 | Thumm . | |
| 3,194,361 | 7/1965 | Thurman | 52/239 |
| 3,352,075 | 11/1967 | Werner et al. | 52/239 |
| 3,973,616 | 8/1976 | Jensen | 160/199 |
| 3,987,837 | 10/1976 | Hewson | 160/206 |
| 4,161,850 | 7/1979 | Peterson et al. | 52/71 X |
| 4,630,416 | 12/1986 | Lapins et al. | 52/239 |
| 4,638,608 | 1/1987 | Coy | 52/98 |
| 4,731,961 | 3/1988 | Bona | 52/71 X |
| 4,881,353 | 11/1989 | Braendel et al. | 52/239 |
| 5,080,160 | 1/1992 | Gephart et al. | 160/199 X |
| 5,167,575 | 12/1992 | MacDonald | 52/71 X |
| 5,301,735 | 4/1994 | Chen | 160/199 |
| 5,364,311 | 11/1994 | Chou | 160/135 X |
| 5,660,011 | 8/1997 | Bleeker et al. | 52/239 |
| 5,896,710 | 4/1999 | Hoyle | 52/144 |

FOREIGN PATENT DOCUMENTS

| | | | |
|---|---|---|---|
| 2046325 | 11/1980 | United Kingdom | 52/71 |

*Primary Examiner*—Carl D. Friedman
*Assistant Examiner*—Timothy B. Kang
*Attorney, Agent, or Firm*—Michael R. McKenna

[57] ABSTRACT

A storage partition adapted for partitioning an area proximate a corner or along a flat wall having a partitioning means selectively repositionable between (a) a first position wherein access to the area is prohibited and (b) a second position wherein unimpeded rolling access to the area, via a floor surface, is permissible.

4 Claims, 2 Drawing Sheets

APPARATUS FOR SECURELY AND SAFELY PARTITIONING AN AREA

FIELD OF THE INVENTION

The present invention is directed to an apparatus for selectively partitioning an area and, more particularly, to a storage partition adapted for use, for example, in a gymnasium, for partitioning an area proximate a corner or along a flat wall.

BACKGROUND OF THE INVENTION

School districts, in particular, have building structures that have various areas that are commonly accessed by students and other individuals, such as multi-purpose rooms, school gymnasiums and recreational areas. These areas generally have numerous entranceways and are often times occupied by individuals during times other than normal school and/or working hours. For example, it is not uncommon to have a school gymnasium occupied during evening hours by individuals playing basketball, volleyball, or the like.

As a result of the continuous accessibility to the above-mentioned areas, which are identified as being merely illustrative and in no way meant to be exclusive to the types of areas in which the present invention may be utilized, school districts are generally concerned about both safety and security in these areas. If adequate storage space is not provided in these areas, and often times it is not, such items, including but not limited to, mobile folding cafeteria tables, folding tables, gym apparatus, folding chairs, stacking chairs, scorers tables and other potential tripping/injury hazards have no place to be safely stored. Further, leaving these items out in the open where they are readily viewed and accessible invites a would be thief to pilfer the item for their own use. Generally, the stealing of such items takes place during evening hours when the only employee in the school is normally a janitor who is generally preoccupied with attending to other duties.

SUMMARY OF THE INVENTION

An apparatus is provided for partitioning a corner area defined by first and second walls including a third wall selectively mounted to one of the first and second walls and extending substantially perpendicular therefrom, and a partitioning structure for selectively partitioning the corner area, the partitioning structure selectively repositionable between (a) a first position wherein access to the corner area is prohibited and (b) a second position wherein unimpeded rolling access to the area, via a floor surface, is permissible.

The partitioning structure may include a bi-fold door assembly.

The bi-fold door assembly may include a first door pivotally mounted along one lengthwise edge to the other of the first and second walls, and a second door pivotally mounted along one lengthwise edge to the other lengthwise edge of the first door. The first and second doors may be selectively repositionable between (a) a first position wherein the first and second doors extend edge to edge lengthwise substantially perpendicular to the other of the first and second walls, with the other lengthwise edge of the second wall adjacent the third wall, and (b) a second position wherein the first and second doors are substantially parallel to the other of the first and second walls.

A track may be provided having a length defined by opposing ends, with one end of the track mounted to the third wall and the other end of the track mounted to the other of the first and second walls. A mounting structure may also be provided for mounting the second door to the track for guided sliding movement relative to the track between the first and second positions.

The track may have a U-shaped cross-section with a base having downwardly disposed legs, the legs having opposing inner surfaces each having inwardly directed flanges formed thereon extending the length of the track and defining a slot.

The mounting structure may include a stem member extending from a top edge of the second door and terminating in an enlarged head greater in size than the slot and slidably supported by the flanges.

The first wall and first and second doors may each include an inner surface and an outer surface, with the outer surface of each of the third wall and first and second doors including a padded covering mounted thereon.

The third wall may be selectively and pivotally mounted along one lengthwise edge to one of the first and second walls, with the third wall being selectively pivotable between (a) a first position and (b) a second position extending substantially perpendicular from said one of the first and second walls.

A securing structure may be provided for releasably securing the third wall against lateral movement relative to the floor.

The securing structure may include a plurality of cooperating loops and hooks, the loops disposed on one of the bottom edge of the third wall and a corresponding location on the floor, and the hooks disposed on the other of the bottom edge of the third wall and the corresponding location on the floor.

The securing structure may alternatively include a peg member extending from one of the bottom edge of the third wall and floor received in a corresponding hole disposed in the other of the bottom edge of the third wall and floor.

The peg member may include a breakaway peg member breakable at a predetermined shear force.

A cooperating locking structure may be provided on the third wall and the second door for securing the first and second doors against movement relative to the third wall with the first and second doors in their first position.

The second wall may be selectively and pivotally mountable along the first wall similar to the third wall and extending substantially perpendicular from the first wall, with all other aspects of the present invention remaining the same. The second wall may include an inner surface and an outer surface, with the outer surface including a padded covering mounted thereon.

The above and other novel features of the present invention will be more fully apparent from the following detailed description when the same is read in connection with the accompanying drawings.

DETAILED DESCRIPTION OF THE PREFERRED EMBODIMENTS

Figure 1:
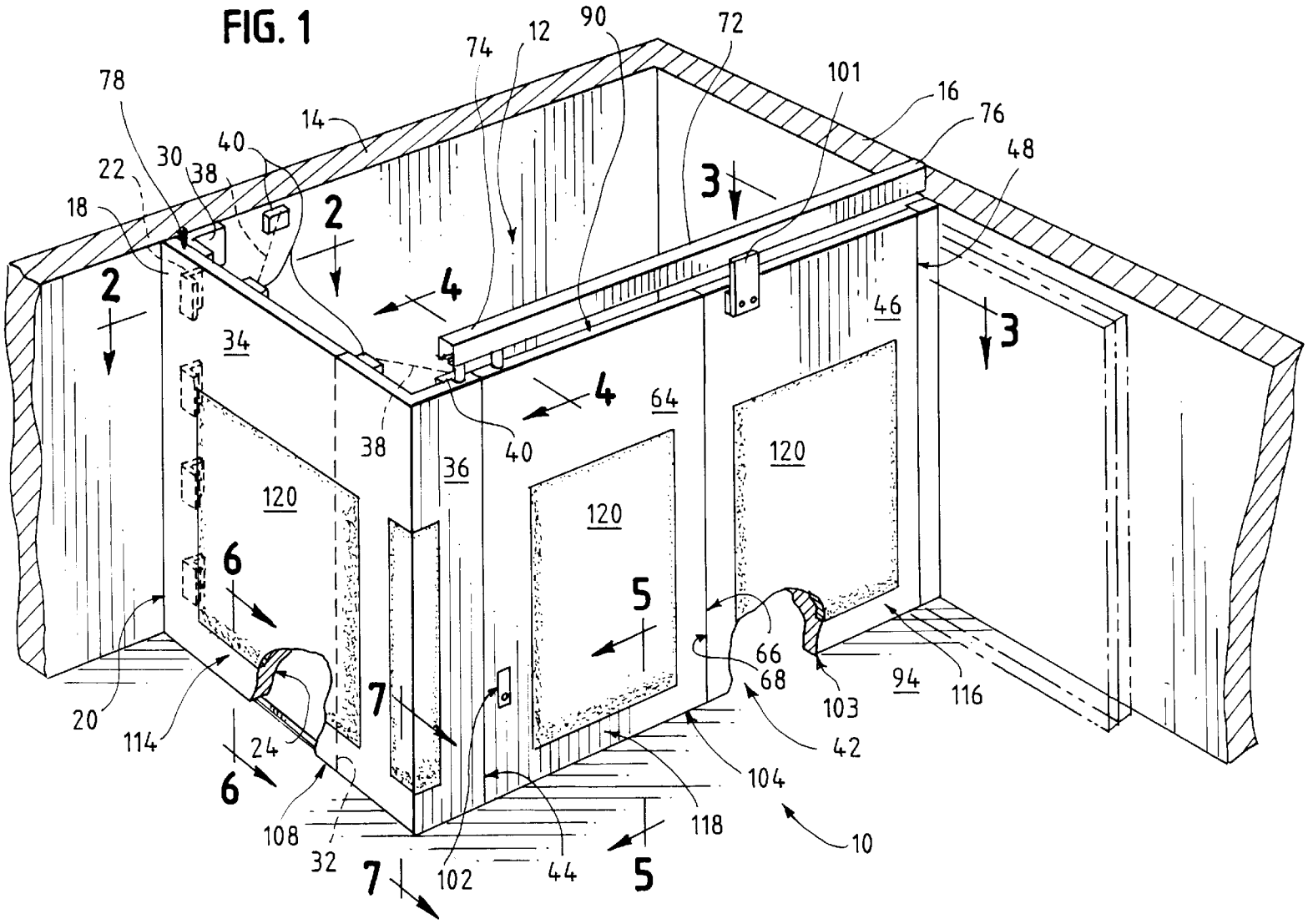
FIG. 1 is a perspective view of a partitioning device according to a first embodiment of the present invention.

Referring to FIG. 1, a perspective view of a first embodiment of the inventive partitioning device is shown at 10. The elements in FIG. 1, when assembled as will be more fully described below, will provide a device for partitioning an area 12, such as, but not limited to, defined by first and second walls 14,16.

The partitioning device 10 includes a third wall 18 mounted along one lengthwise edge 20 to the first wall 14 and extends substantially perpendicular therefrom. The third wall 18 may be selectively mounted to the first wall 14 at numerous locations depending upon the size of the area 12 desired to be partitioned. The size of the third wall 18 may also vary depending upon the size of the area 12 desired to be partitioned. It should be noted that the terms "first wall" and "second wall", as used herein, are interchangeable.

The third wall 18 may be fixedly mounted to the first wall 14 via angle brackets 22. As shown more particularly in FIG. 2, the angle brackets 22 are disposed against an inner surface 24 of the third wall 18 and against the first wall 14. The angle brackets 22 are preferably secured to the first wall 14 via lag screws 26, but may be secured by any conventional means. Similarly, the angle brackets 22 are secured to the third wall 18 via screws 28 or other conventional means. In the embodiment shown in FIG. 1, four angle brackets 22 are utilized, however, depending upon the size of the third wall 18, more or less angle brackets 22 may be required.

The third wall 18 may alternatively be pivotally mounted to the first wall 14 via hinges 30, only one of which is shown in FIG. 1. In this alternative embodiment, the angle brackets 22 would not be utilized and the third wall 18 would be selectively pivotable between (a) a first position wherein the third wall 18 extends substantially parallel to the first wall 14 and (b) a second position wherein the third wall 18 extends substantially perpendicular from the first wall 14. FIG. 1 depicts the third wall 18 in its second position.

In a preferred form, the third wall 18 has an L-shaped cross-section when viewed from the top. The third wall 18 may be made of a single, solid piece of material, or alternatively may include two sections as indicated by dotted line 32 in FIG. 1. In this form, the third wall 18 would include a panel member 34 attached, via brackets (not shown) on the inner surface 24, to a corner member 36. Support rods, shown dotted at 38, may be provided at each corner attached to corresponding brackets 40. It should be noted, however, that the third wall 18 need not necessarily have an L-shaped cross-section, but may include a variety of geometric cross-sectional configurations depending upon the geometric configuration of the area 12 desired to be partitioned.

A bi-fold door assembly, shown generally at 42, is provided between the other lengthwise edge 44 of the third wall and the second wall 16. The bi-fold door assembly 42 includes a first door 46 pivotally mounted along one lengthwise edge 48 to the second wall 16. As shown more particularly in FIG. 3, the first door 46 is pivotally mounted to the second wall 16 via U-shaped brackets 50,52 and a hinge 54. The base 56 of U-shaped bracket 50 is anchored to the second wall 16 via conventional fastening means. The legs 58 of U-shaped bracket 50 are mounted to the legs 60 of U-shaped bracket 52, and the first door 46 is pivotally mounted, via hinge 54, to the base 62 of U-shaped bracket 52.

Figures 2, 3, 4, 5, 6, 7, 8:
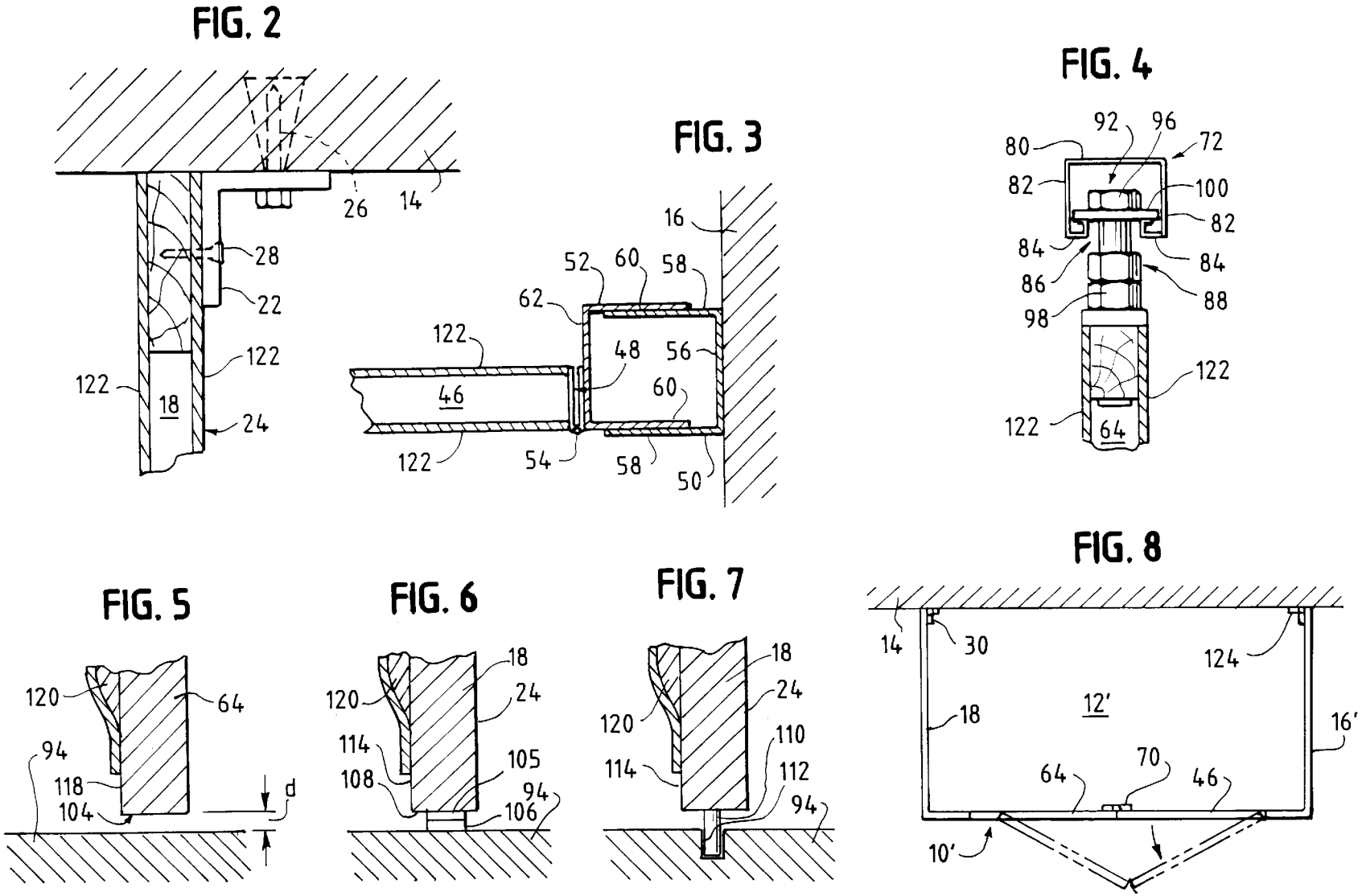
FIG. 2 is a cross-sectional view taken along line 2—2 in FIG. 1.
FIG. 3 is a cross-sectional view taken along line 3—3 in FIG. 1.
FIG. 4 is a cross-sectional view taken along line 4—4 in FIG. 1.
FIG. 5 is a cross-sectional view taken along line 5—5 in FIG. 1.
FIG. 6 is a cross-sectional view taken along line 6—6 in FIG. 1.
FIG. 7 is a cross-sectional view taken along line 7—7 in FIG. 1.
FIG. 8 is a plan view of a partitioning device according to a second embodiment of the present invention.

The bi-fold door assembly 42 further includes a second door 64 pivotally mounted along one lengthwise edge 66 to the other lengthwise edge 68 of the first door 46 via a hinge 70 (shown in FIG. 8). A track 72 is provided between the opening defined by the third wall 18 and second wall 16. The track 72 includes opposing ends 74,76 with one end 74 of the track 72 mounted to the third wall 18 at its upper edge 78 and the other end 76 of the track 72 mounted to the second wall 16.

As shown more particularly in FIG. 4, the track 72 includes a base 80 having downwardly disposed legs 82. The opposing inner surfaces of the legs 82 include opposing flanges 84 defining a lengthwise slot 86 for a purpose to be described hereafter. The track 72 is attached to the third wall 18 and second wall 16 via any suitable attachment means.

A stem member 88 projects from a top edge 90 of the second door 64. The stem member 88 includes an enlarged head 92 greater in size than the slot 86. The enlarged head 92 is slidably supported by the flanges 84 for guided sliding movement permitting selective repositioning the first and second doors 46,64 between (a) a first position wherein access to the area 12 is prohibited, as shown in FIG. 1, and (b) a second position wherein unimpeded rolling access to the area, via a floor surface 94 is permissible (as shown in dotted form in FIG. 1). The enlarged head 92 may include a hex head 96 of a hex screw 98 and a washer 100, with the hex head 96 and/or washer 100 generally being greater in size than the slot 86. However, other configurations are also contemplated.

As shown in FIG. 1, a closing stop plate 101 is mounted on the first door 46 to prevent over-pivoting of the first and second doors 46,64. The closing stop plate 101 is mounted via conventional mounting means and extends upward from the first door 46 such that the stop plate 101 will engage the track 72 should the first and second doors 46,64 be extended beyond their first position. It should be apparent that the stop plate 101 may also be attached to the second door 64 without losing any of its useful functionality.

A cooperating conventional locking structure 102 is provided between the second door 64 and third wall 18 for securing the area 12 against access with the first and second doors 46,64 in their first position. The locking structure 102 may include, but by no means is limited to, a deadbolt locking mechanism, a doorknob type mechanism and/or a hook and latch type mechanism securable with a separate lock.

It is important to note that since the track 72 is mounted generally above the first and second doors 46,64, the floor area 94 proximate the bi-fold door assembly 42 remains clear of any structure that would impede rolling access to the storage area 12. More particularly, as shown in FIG. 5, the bottom edges 103,104 of the first and second doors 46,64 are maintained at a predetermined distance d from the floor 94. By maintaining the distance d between the bottom edges 103,104 of the first and second doors 46,64 and the floor 94, the bi-fold door assembly 42 may be smoothly and easily operated without damaging, or necessitating the mounting of further additional structure to, the floor 94. Thus the partitioning device 10 of the present invention is conducive for the storage of such items as folding cafeteria tables and other apparatus which include wheels allowing them to be transported by rolling them along the floor 94.

As shown more particularly in FIG. 6, the third wall 18 may be releasably secured against lateral movement relative to the floor 94 by means of cooperating hooks and latches 105,106 disposed on the bottom edge 108 of the third wall 18 and a corresponding location on the floor 94. While FIG. 6 depicts the hooks 105 mounted to the bottom edge 108 of the third wall 18 and the latches 106 mounted to the floor 94, it should be apparent that the hook 105 and latch 106 mountings may be interchanged. This type of fastening is more commonly known as Velcro®-type fastening.

Alternatively, as shown in FIG. 7, a peg member 110 may be provided extending from the bottom edge 108 of the third wall 18 for releasably securing the third wall 18 against lateral movement relative to the floor 94. The peg member 110 is received in a corresponding hole 112 formed in the floor 94 and may be breakable at a predetermined shear force. Similarly, the peg member 110 and hole 112 configuration may be interchanged.

It should be noted that both of the above-described releasable securing structures allows the third wall 18 to give a little in the event that it is forcibly run into by a person who may be playing basketball or another sport. This would help lessen injury to such person while still maintaining any articles stored in the area 12 safely secured.

Further, the outer surface 114,116,118 of each of the third wall 18, first door 46 and second door 64 includes a padded covering 120 mounted thereon to help further minimize injury in the event a person runs into the partitioning device 10. The padded covering 120 is preferably constructed of a ⅜" CDX plywood back, a bonded polyurethane foam and a heavy duty vinyl coated nylon that is mildew, abrasion, and puncture resistant with a leather pattern emboss.

In a preferred form, the third wall 18, first door 46 and second door 64 are constructed of spaced aluminum panels 122, as shown in FIGS. 2, 3 and 4, respectively, each having an internal cross-brace design (not shown) for structural soundness.

An alternate embodiment of the partitioning device 10 of the present invention will now be described with reference to FIG. 8, with similar structures including the same reference numerals and those elements which have been modified indicated with a prime (′). As depicted in FIG. 8, the partitioning device 10′ has been slightly modified in that instead of being a fixed wall, the second wall 16′ is selectively and hingably mounted to the first wall 14 via hinge 124. The second wall 16′ may be a mirror image of third wall 18, or may vary in geometric configuration depending upon the geometric configuration of the area 12′ desired to be partitioned.

In this alternative embodiment, the second wall 16′ would also include a padded covering 120 mounted on an outer surface thereof and would be releasably secured against lateral movement relative to the floor 94 in the same manner as previously described for the third wall 18. Accordingly, the partitioning device 10′ may be utilized along a single flat wall for partitioning off a selected area 12′. It should be noted, however, that while FIG. 8 depicts both the third wall 18 and second wall 16′ as selectively and hingably mounted to the first wall 14, the present invention also contemplates mounting one of the second and third walls 16′, 18 or both of the second and third walls 16′,18 to the first wall 14 via angle brackets 22.

The foregoing disclosure of the specific embodiments of the present invention is intended to be illustrative of the broad concepts comprehended by the invention and is not to be construed as limiting the invention in any manner.

I claim:

1. An apparatus for securely and safely partitioning an area, partially bounded by a building structure having first and second walls defining a corner, comprising:

a. a third wall selectively mounted to one of the first and second walls and extending at an angle therefrom;

b. means for preventing injury from occurring in the event a person runs into the apparatus while securely maintaining any articles disposed in the area comprising means for releasably securing the third wall against lateral movement while allowing the third wall to move laterally in the event a person runs into the apparatus, said means for releasably securing the third wall against lateral movement comprises a plurality of cooperating loops and hooks, said loops being disposed on one of a bottom edge of the third wall and a corresponding location on the floor, and said hooks disposed on the other of the bottom edge of the third wall and the corresponding location on the floor; and c. means for selectively partitioning the area, said means for selectively partitioning the area being selectively repositionable between (a) a first position wherein access to the area is prohibited and (b) a second position wherein unimpeded rolling access to the area, via a floor surface, is permissible, said area being circumscribed by the first and second walls, the third wall and the partitioning means.

2. An apparatus for securely and safely partitioning an area, partially bounded by a building structure having first and second walls defining a corner, comprising:

a. a third wall selectively mounted to one of the first and second walls and extending at an angle therefrom;

b. means for preventing injury from occurring in the event a person runs into the apparatus while securely maintaining any articles disposed in the area comprising means for releasably securing the third wall against lateral movement while allowing the third wall to move laterally in the event a person runs into the apparatus, said means for releasably securing the third wall against lateral movement comprises at least one breakaway peg member extending from one of the bottom edge of the third wall and the floor received within a like number of cooperating holes formed in the other of the bottom edge of the third wall and the floor, said at least one breakaway peg member being breakable at a predetermined shear force to allow the third wall to move laterally to prevent injury in the event a person runs into the apparatus; and c. means for selectively partitioning the area, said means for selectively partitioning the area being selectively repositionable between (a) a first position wherein access to the area is prohibited and (b) a second position wherein unimpeded rolling access to the area, via a floor surface, is permissible, said area being circumscribed by the first and second walls, the third wall and the partitioning means.

3. An apparatus for securely and safely partitioning an area, partially bounded by a building structure having a first wall, comprising:

a. second and third walls selectively mounted to the first wall and extending substantially perpendicular therefrom, b. means for preventing injury from occurring in the event a person runs into the apparatus while securely maintaining any articles disposed in the area including at least one of the second and third walls being also pivotally mounted to the first wall, said means for preventing injury from occurring while securely maintaining any articles comprises means for releasably securing at least one of the second and third walls against lateral movement allowing the at least one of the second and third walls to move laterally in the event a person runs into the apparatus, said means for releasably securing the at least one of the second and third walls against lateral movement comprises a plurality of cooperating loops and hooks, said loops disposed on one of a bottom edge of the at least one of the second and third walls and a corresponding location on the floor, and said hooks disposed on the other of the bottom edge of the at least one of the second and third walls and the corresponding location on the floor; and c. a bi-fold door assembly comprising:

(1) a first door pivotally mounted along one lengthwise edge to one of the second and third walls, (2) a second door pivotally mounted along one lengthwise edge to the other lengthwise edge of the first door, and (3) a track having opposing ends defining a length, with one end mounted to the second wall and the other end mounted to the third wall; and d. means for mounting the first and second doors to the track for guided sliding movement relative to the track between (a) a first position wherein access to an area defined by the first, second and third walls and first and second doors is prohibited and (b) a second position wherein unimpeded rolling access to the area, via a floor surface, is permissible, said area being circumscribed by said first, second, and third walls, and the bi-fold door.

4. An apparatus for securely and safely partitioning an area, partially bounded by a building structure having a first wall, comprising:

a. second and third walls selectively mounted to the first wall and extending substantially perpendicular therefrom, b. means for preventing injury from occurring in the event a person runs into the apparatus while securely maintaining any articles disposed in the area including at least one of the second and third walls being also pivotally mounted to the first wall, said means for preventing injury from occurring while securely maintaining any articles comprises means for releasably securing at least one of the second and third walls against lateral movement allowing the at least one of the second and third walls to move laterally in the event a person runs into the apparatus, said means for releasably securing the at least one of the second and third walls against lateral movement comprises at least one breakaway peg member extending from one of the bottom edge of the at least one of the second and third walls and the floor received within a like number of cooperating holes formed in the other of the bottom edge of the at least one of the second and third walls and the floor, said at least one breakaway peg member breakable at a predetermined shear force to allows the at least one of the second and third walls to move laterally to prevent injury in the event a person runs into the apparatus; and c. a bi-fold door assembly comprising:

(1) a first door pivotally mounted along one lengthwise edge to one of the second and third walls, (2) a second door pivotally mounted along one lengthwise edge to the other lengthwise edge of the first door, and (3) a track having opposing ends defining a length, with one end mounted to the second wall and the other end mounted to the third wall; and d. means for mounting the first and second doors to the track for guided sliding movement relative to the track between (a) a first position wherein access to an area defined by the first, second and third walls and first and second doors is prohibited and (b) a second position wherein unimpeded rolling access to the area, via a floor surface, is permissible, said area being circumscribed by said first, second, and third walls, and the bi-fold door.

* * * * *